US007905069B1

(12) United States Patent
Lockwood

(10) Patent No.: US 7,905,069 B1
(45) Date of Patent: Mar. 15, 2011

(54) REINFORCING SYSTEMS TO STRENGTHEN MONOPOLE TOWERS

(75) Inventor: James D. Lockwood, Boulder, CO (US)

(73) Assignee: Aero Solutions, LLC, Boulder, CO (US)

( * ) Notice: Subject to any disclaimer, the term of this patent is extended or adjusted under 35 U.S.C. 154(b) by 752 days.

(21) Appl. No.: 11/648,415

(22) Filed: Dec. 29, 2006

Related U.S. Application Data

(60) Provisional application No. 60/755,180, filed on Dec. 30, 2005.

(51) Int. Cl.
*E04G 23/00* (2006.01)
*E04H 12/00* (2006.01)

(52) U.S. Cl. ..... 52/514; 52/651.01; 52/651.02; 52/152

(58) Field of Classification Search ..... 52/245, 52/248, 514, 834–836, 843, 845, 848, 849, 52/127.2, 170, 651.1, 651.11, 651.01, 690, 52/651.02, 152; 248/74.1–74.5; 156/71, 156/91–92
See application file for complete search history.

(56) References Cited

U.S. PATENT DOCUMENTS

| | | | | | |
|---|---|---|---|---|---|
| 761,294 | A * | 5/1904 | Griveaud | 52/845 |
| 3,738,072 | A * | 6/1973 | Adrian | 52/170 |
| 3,785,107 | A * | 1/1974 | Garretson | 52/514 |
| 4,697,396 | A * | 10/1987 | Knight | 52/170 |
| 4,713,129 | A * | 12/1987 | Inhofe et al. | 156/71 |
| 4,905,429 | A * | 3/1990 | Fukushima et al. | 52/127.5 |
| 4,934,114 | A * | 6/1990 | Lindsey | 52/40 |
| 4,987,718 | A * | 1/1991 | Knight | 52/741.14 |
| 5,033,949 | A * | 7/1991 | Jewett | 425/12 |
| 5,309,692 | A * | 5/1994 | Hayashi et al. | 52/742.14 |
| 5,822,942 | A * | 10/1998 | Lucia, Jr. | 52/514 |
| 6,108,996 | A * | 8/2000 | McGinnis | 52/651.02 |
| 6,151,860 | A * | 11/2000 | Reisdorff | 52/651.02 |
| 6,453,636 | B1 | 9/2002 | Ritz | |
| 6,561,736 | B1 * | 5/2003 | Doleshal | 405/251 |
| 6,694,698 | B2 | 2/2004 | Ryan | |
| 6,901,717 | B2 | 6/2005 | Brunozzi et al. | |
| 6,915,618 | B2 | 7/2005 | Payne | |
| 7,033,120 | B2 | 4/2006 | Huenagl et al. | |
| 7,116,282 | B2 | 10/2006 | Trankina | |
| 7,253,786 | B1 * | 8/2007 | Logozzo | 343/890 |
| 7,392,624 | B2 * | 7/2008 | Kinzer | 52/194 |
| 2004/0020158 | A1 * | 2/2004 | Kopshever, Sr. | 52/723.2 |
| 2004/0134161 | A1 * | 7/2004 | Lockwood et al. | 52/736.1 |
| 2004/0139665 | A1 | 7/2004 | Ullrich et al. | |

* cited by examiner

*Primary Examiner* — Richard E Chilcot, Jr.
*Assistant Examiner* — Mark R Wendell
(74) *Attorney, Agent, or Firm* — Jacox, Meckstroth & Jenkins

(57) ABSTRACT

An existing vertical monopole tower is reinforced by a plurality of vertically extending metal reinforcing members in the form of elongated channel members or angle plate members or ribbed plate members. The reinforcing members have longitudinally spaced holes which align with vertically spaced holes in the tower wall, and blind fasteners extend through the aligned holes to secure the reinforcing members to the tower. The fasteners provide for transferring only tensile forces or tensile and shear forces to the reinforcing members. Vertically aligned reinforcing members have adjacent end portions spliced together by splice plates and blind fasteners, and the splice plates are fastened to the web portions of the channel members or the ribs of the rib plate members or the wing portions of the angle plate members. Shear plates and pin assemblies may also be used to transfer shear forces and in splicing vertically aligned reinforcing members.

2 Claims, 14 Drawing Sheets

REINFORCING SYSTEMS TO STRENGTHEN MONOPOLE TOWERS

BACKGROUND OF THE INVENTION

One method for reinforcing monopole tower structures, such as a tower supporting communication antennas and herein referred to as a monopole or tower, comprises attaching flat plates or tubes to the monopole by welding or structural adhesives or bolts, for example, as disclosed in U.S. Pat. No. 6,694,698. These reinforcing elements or members are placed against the flat surfaces of an 8-sided, 12-sided, 16-sided or 18-sided monopole and act integral with the modified structure once connected. The challenge facing a welded solution is that fires can ignite if sparks fall onto exposed cables or the surrounding ground surface. The challenge facing adhered reinforcing members is that the monopole surface must be carefully prepared in advance of bonding reinforcing plates with adhesive to the pole and installations become difficult to manage in rain or in very cold weather conditions. The challenge facing bolted-on members using flat plates is that the bolt spacing must be short to control localized buckling of the flat plates in compression due to the low moment of inertia of a plate section. Other methods and apparatus for reinforcing monopole towers are disclosed in U.S. Pat. No. 6,453,636, No. 6,901,717, No. 6,915,618, No. 7,116,282 and published U.S. application No. 2004/0139665.

SUMMARY OF THE INVENTION

The present invention is directed to monopole reinforcing systems that include new reinforcing members and members which connect the reinforcing members to an existing monopole such that 1) local buckling of the reinforcing members do not occur under axial compression forces, 2) no overstress conditions occur in the reinforcing members in tension or compression, and 3) axial forces are transferred from the pole to the reinforcing members through shear resistance of the connector members. A desirable feature is that the reinforcing systems of the invention optimize the vertical distance or spacing between the connectors along the length of the reinforcing members to reduce field installation time.

The reinforcing members of the invention have cross-sections which provide increased moments of inertia to increase their local buckling capacity. Connectors are installed between the ends of the reinforcing members to resist tensile forces normal to the surface of the pole shaft. These connectors may also transfer shear forces or be used only for the purpose of carrying tension. The reinforcing members are placed symmetrically around the monopole structure and can use as few as three members and up to any practical limit not exceeding the total number of flats or space available around the monopole.

The present invention includes reinforcing members of three cross-section types and three types of connectors for attaching the reinforcing members to an existing monopole. Splice connectors allow for accommodating slip joints in the existing monopole, and the reinforcing systems allow for strengthening an 8-sided, 12-sided, 16-sided, 18-sided, and a round monopole. The selection of the connector used depends on the load transfer method preferred and the location of the connector along the length of the reinforcing member. These locations are identified as the reinforcing member's end, splice and mid-section. The types of reinforcing members are (1) a folded or angle type, (2) a channel type, and (3) a ribbed type.

The connector types are (1) a tensile connector, (2) a tensile shear connector, and (3) a plate with shear pins. The purpose of the connectors are to transfer excess axial loads being placed into the monopole under wind loading into the external reinforcing members, thereby maintaining allowable stress levels in the monopole. These axial loads are transferred from the monopole into the reinforcing members using tensile shear connectors and/or plates with shear pins. Another purpose of the connectors is to eliminate localized buckling in the reinforcing members when they are under compression. This is accomplished by restraining each reinforcing member from movement out of its generally vertical plane. This is accomplished by using tensile connectors or tensile shear connectors.

Other features and advantages of the invention will be apparent from the following description, the accompanying drawings and the appended claims.

DESCRIPTION OF THE PREFERRED EMBODIMENTS

Figure 1:
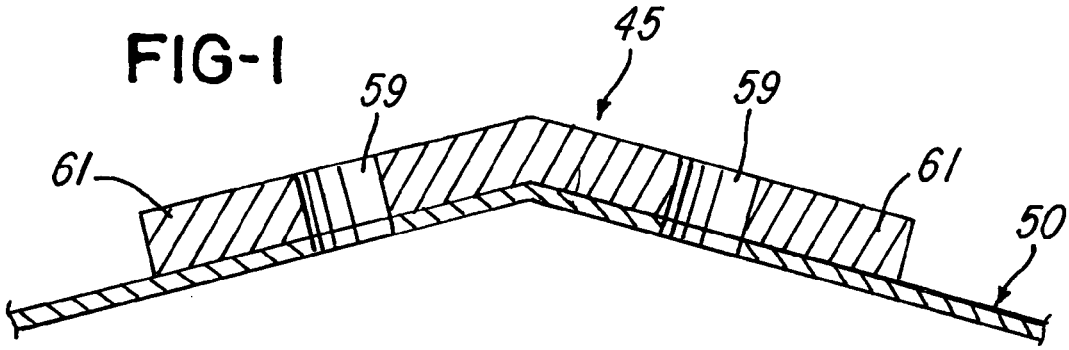
FIG. 1 is a fragmentary section of a monopole wall with a folded or angled reinforcing member mounted on the wall in accordance with one embodiment of the invention.
Figure 8:
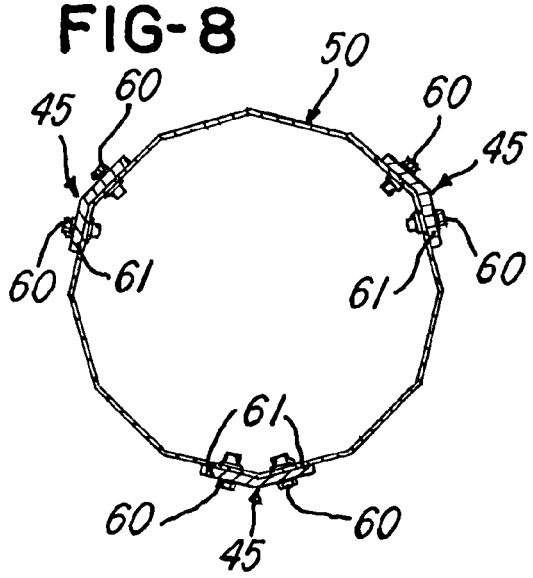
FIG. 8 is a greatly reduced horizontal section through a monopole wall and having folded or angle reinforcing members connected to the wall in accordance with the invention.
Figure 9:
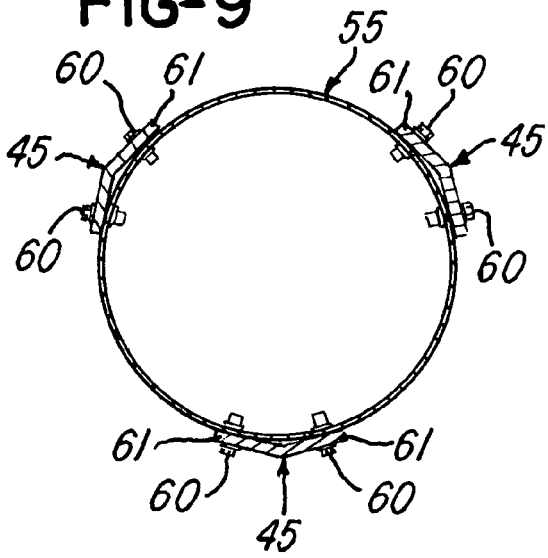
FIG. 9 is a greatly reduced horizontal section of a round monopole wall and having folded or angle reinforcing members connected to the wall in accordance with the invention.

An elongated folded or bent or angled reinforcing plate or member 45 is shown in FIG. 1 and provides optimal effectiveness of a reinforcing member to reduce forces in a vertical monopole tower 50, herein referred to as monopole or tower, by the fact that it is located at the outermost distance from the neutral or vertical center axis of the monopole. The bend or fold of the reinforcement plate provides for a significant increase of the moment of inertia of the reinforcing member which improves its resistance to localized buckling under compression. The folded or bent member 45 can be applied to any multi-sided monopole 50 (FIG. 8) and to a circular monopole 55 (FIG. 9). The member 45 may also be applied to tapered or uniform diameter monopoles.

Figure 4:
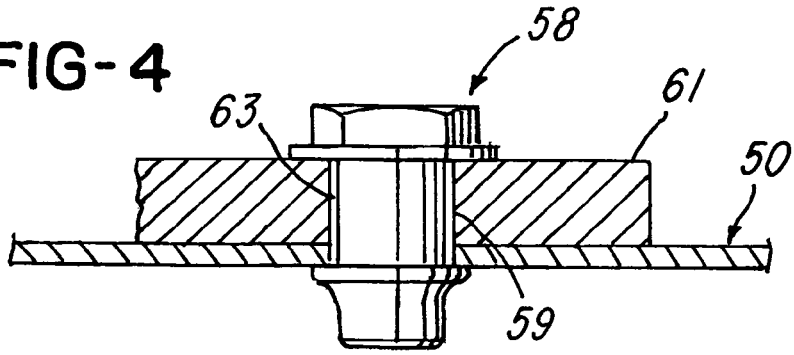
FIG. 4 are fragmentary sections of a monopole wall and reinforcing member with a tensile-type connector for securing the reinforcing member to the wall.
Figure 5:
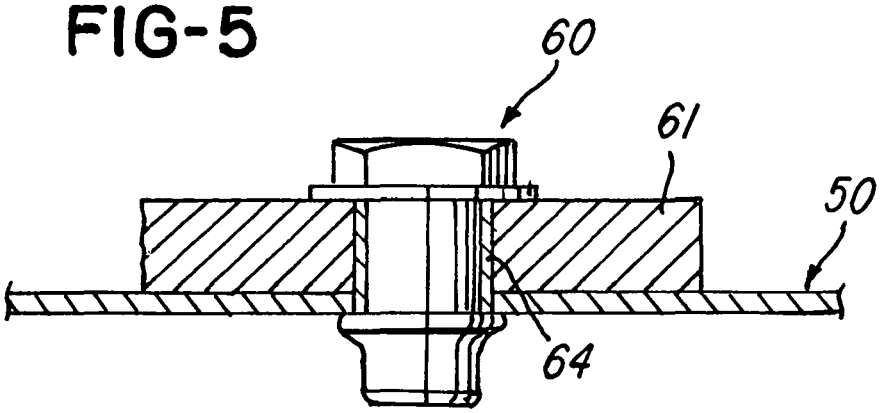
FIG. 5 are fragmentary sections of a monopole wall and reinforcing member with a tensile shear connector connecting the reinforcing member to the wall.
Figure 10:
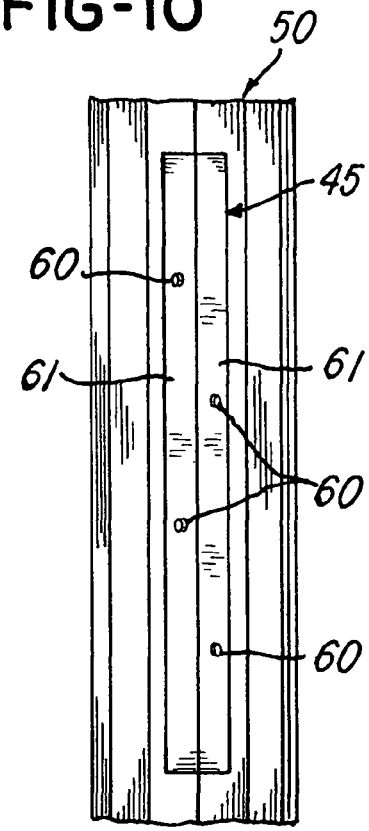
FIG. 10 is a fragmentary elevational view of a monopole and an attached reinforcing member as shown in FIG. 8.

Local buckling of the folded or angled reinforcing member 45 is restrained by intermediate blind connector bolts or connectors 58 (FIG. 4) or connectors 60 (FIG. 5) extending through holes 59 within the flanges or wings 61 of the member 45 and monopole 50 and having a staggered bolt pattern along its vertical length as shown in FIG. 10. The spacing of these bolts varies as a function of the angle of the member, the thickness of the member, total width and strength of the reinforcing member. For example, a 12 sided monopole having the folded or angled reinforcing member 45 may have a fold or angle of 30 degrees between the wings 61, a thickness of one inch, and be ten inches in total width (five inches each wing) and have a yield strength of 65,000. lbs per square inch. The bolt spacing may typically be twenty four inches between bolts in the cross section (staggered pattern) or forty eight inches on each wing of the angle section 45. The width of the member 45 may typically vary from six inches to twelve inches and is placed onto two adjacent flat wall sections of the monopole 50 over a corner of the monopole.

The folded or angle member 45 is fabricated in three standard geometries or configurations. For a 12 sided monopole (FIG. 8), the obtuse angle between the wing portions is 150 degrees, and the member extends in a generally vertical direction of the monopole. For an 18 sided monopole, the angle member 45 has an obtuse angle of 160 degrees at its centerline and between the wing portions 61. For round monopoles 55 (FIG. 9), the angle is such that the wing portions 61 are tangent to the surface of the monopole at approximately the quarter points in (using total width) from the edges of the member 45, as shown in FIG. 9.

Figure 6:
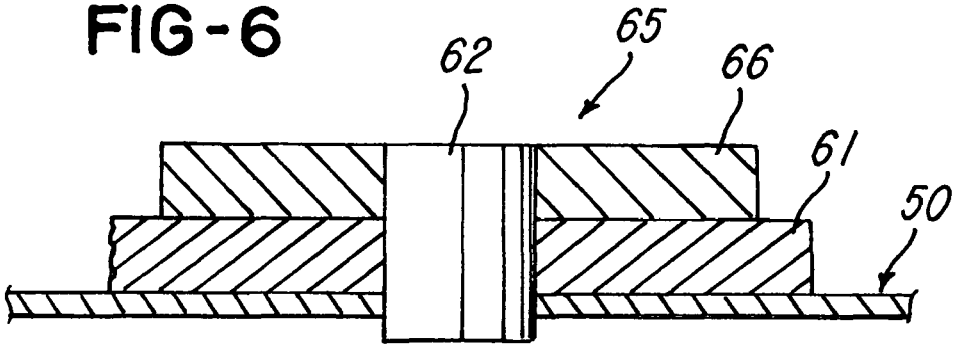
FIG. 6 are fragmentary sections of a monopole wall and reinforcing member with a shear plate and pin connector connecting the reinforcing member to the wall.
Figure 7:
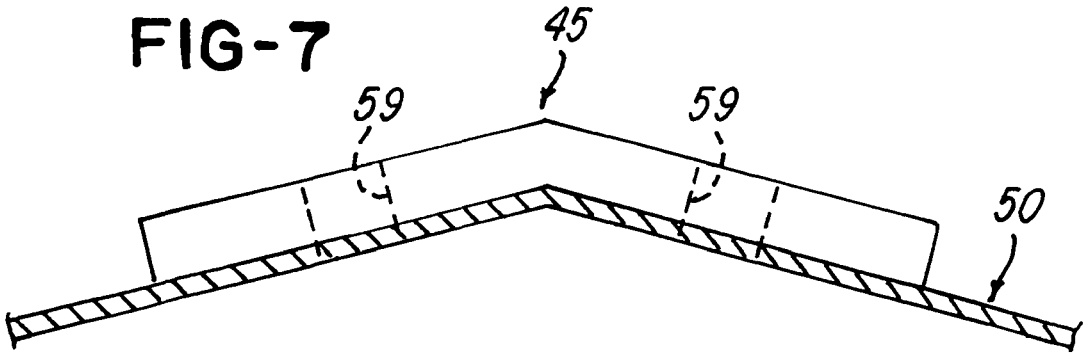
FIG. 7 is an end view of the angle-type reinforcing member shown in FIG. 1 and mounted on a monopole wall.
Figure 11:
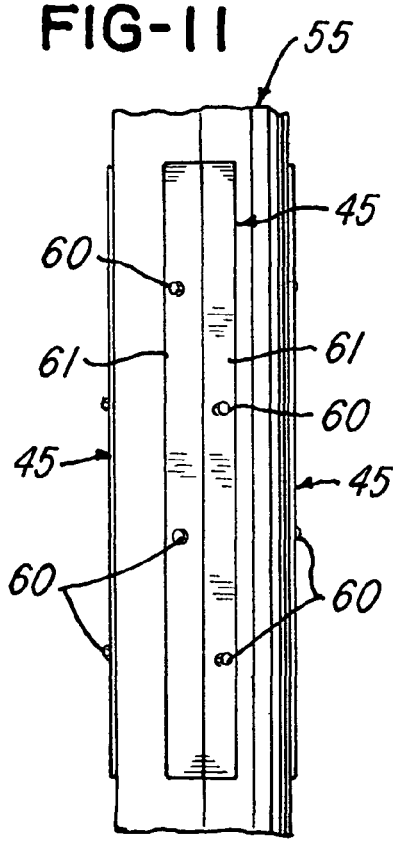
FIG. 11 is a fragmentary elevational view of a round monopole and an attached reinforcing member as shown in FIG. 9.

The folded or angle reinforcing member 45 is typically 20 feet in length (FIGS. 10 & 11) between splices or ends. This length is determined by weight and handling considerations. The reinforcing member 45 is connected to an existing vertical monopole 50 using tensile bolts or connectors 58 (FIG. 4) and/or tensile bolt shear connectors 60 (FIG. 5), and sometimes shear pin connectors 62 (FIG. 6). In most circumstances, a combination of two connector types are used on a reinforcing member. One form of tensile shear connector 60 which eliminates a clearance gap 63 (FIG. 4) and has provided a satisfactory connection is a blind fastener assembly produced by Huck International, Inc. and of the general type, for example, disclosed in U.S. Pat. No. 7,033,120. Each tensile connectors 58 (FIG. 5) may include a pressed-on surrounding shear sleeve 64 (FIG. 5) forming a tight-fit within the hole 59 and between the tensile connector 58 and the wall of the monopole.

Figure 12:
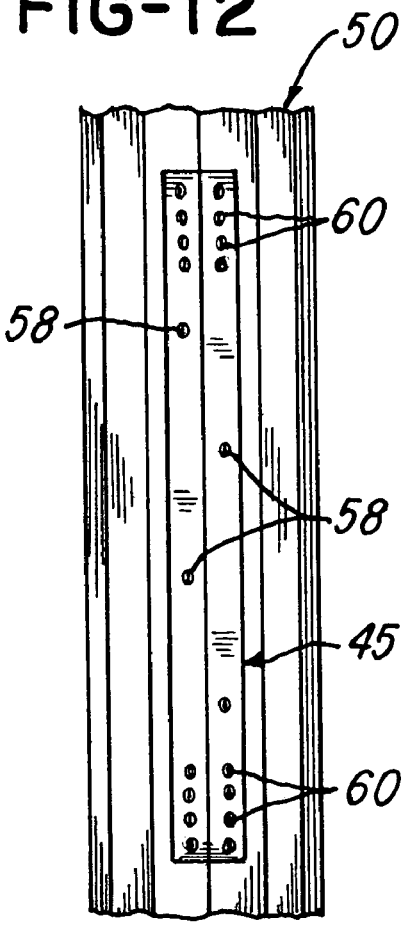
FIG. 12 is a fragmentary elevational view similar to FIG. 10 and with an angle reinforcing member attached to the monopole corner with the tensile connectors and tensile shear connectors shown in FIGS. 4 and 5.
Figure 13:
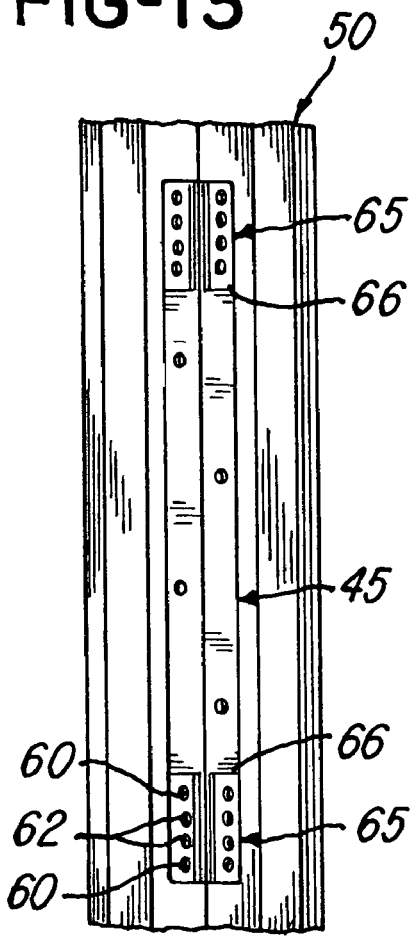
FIG. 13 is a fragmentary elevational view similar to FIG. 12 and showing the assembly of shear pin connectors at opposite end portions of the reinforcing member.
Figure 14:
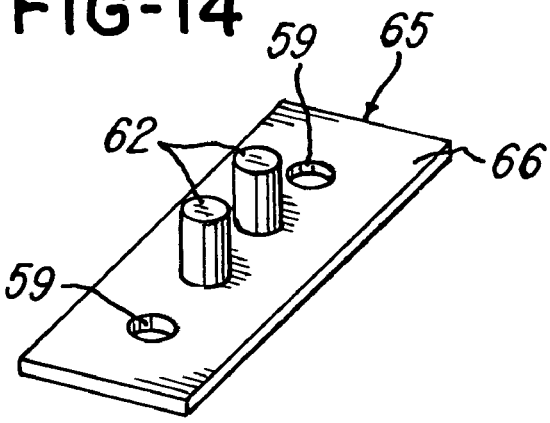
FIG. 14 is a perspective view of a shear pin connector as shown in FIG. 13.
Figure 15:
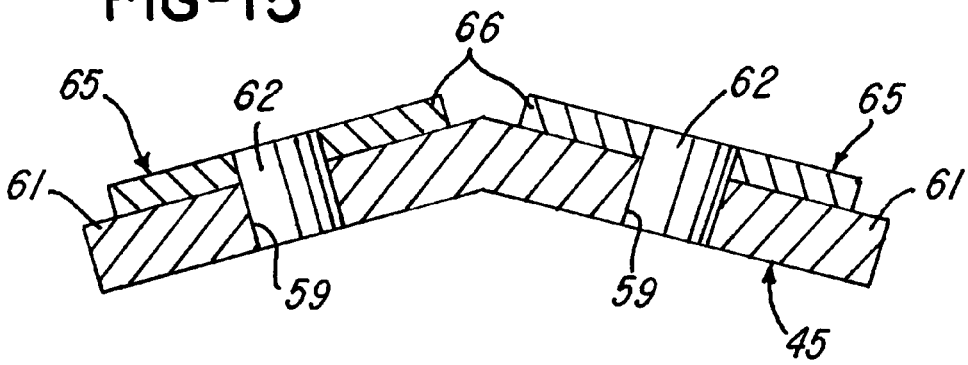
FIG. 15 is a horizontal section of a shear pin connector on a folded or angled reinforcing member.

When the connectors are placed at the ends of the reinforcing members 45 (FIG. 12), the ends of reinforcing members must be capable of transferring excess axial loads from the existing monopole tower to the reinforcing member. This is accomplished through shear transfer between the existing monopole and the reinforcing member. Shear transfer is achieved using tensile shear connectors 60 (FIG. 12) or a shear plate and pin assembly 65 (FIGS. 6 & 14) that includes a plurality of shear pins 62 (FIGS. 13 & 14). The shear plate and pin assembly 65 of FIG. 13 includes a flat plate 66 with pressed in shear dowels or pins 62. The shear plate and pin assembly 65 is secured to the reinforcing member and monopole 50 with tensile shear bolts 60 or tensile bolts 58. In FIG. 14, the shear plate and pin assembly 65 is shown with two shear pins 62 and two outside holes 59 where the tensile shear bolts 60 or tensile bolts 58 are installed. A cross section of the shear plate and pin assembly 65 mounted on each wing portion 61 of a reinforcing member 45 is shown in FIG. 15.

Figure 16:
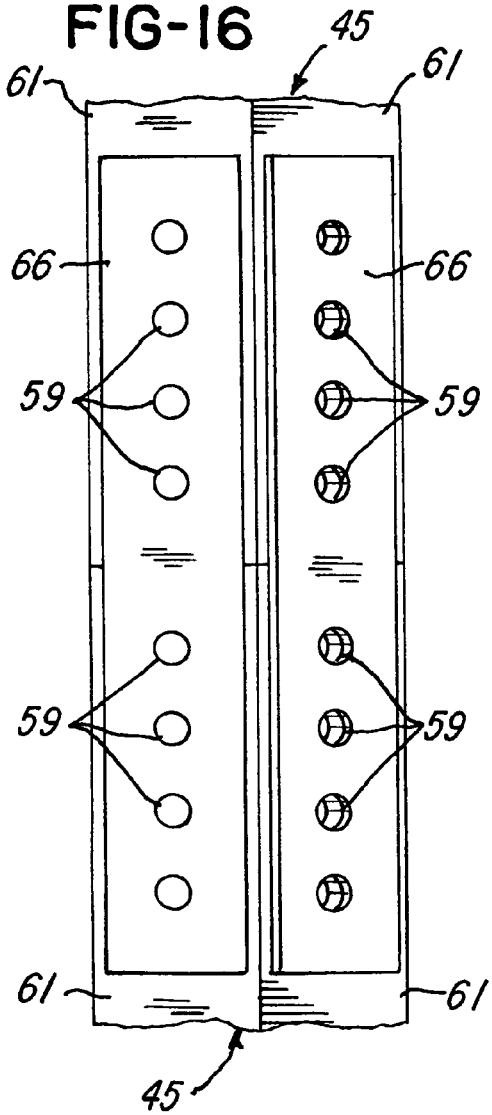
FIG. 16 is a fragmentary elevational view of two vertically aligned angle reinforcing members joined together by splice plates and holes for receiving tensile shear connectors.
Figure 17:
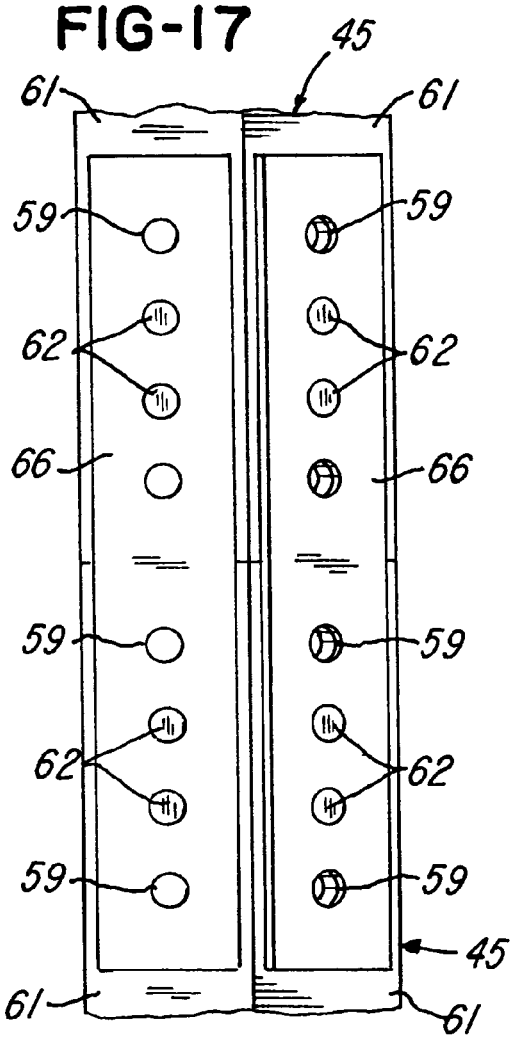
FIGS. 17 and 18 are fragmentary elevational views similar to FIG. 16 and showing splice plates connecting two angle reinforcing members together with shear pin and tensile shear connectors.
Figure 18:
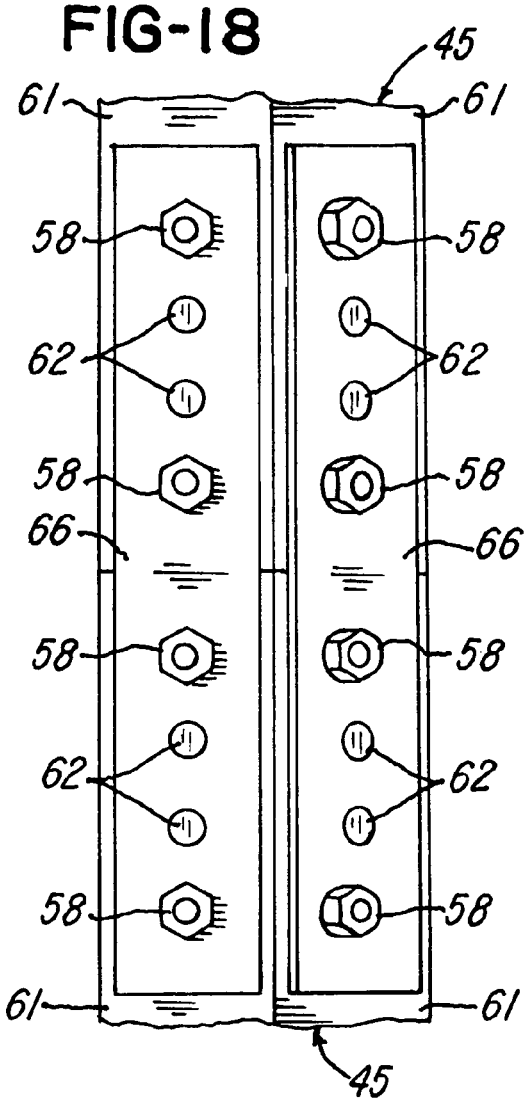

FIGS. 16-18 show splice connections between the end portions of two vertically aligned reinforcing members 45.

The splices have extended plates 66 with tensile shear connectors 60 in holes 59 (FIG. 16), extended shear plate and pin assemblies 65 (FIG. 17) which are connected to the monopole reinforcing member 45 with tensile shear connectors 60 or in combination with only tensile connectors 58. The total number of shear pins in the shear plate and pin assembly 65 may be reduced when tensile shear connectors 60 are used to fasten the shear plate and pin assembly.

Figure 19:
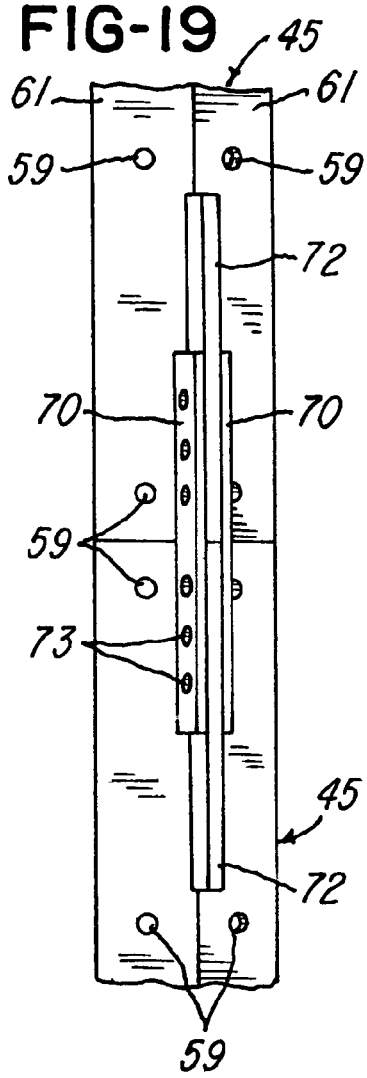
FIG. 19 is a fragmentary elevational view of two vertically aligned reinforcing members joined together with double shear splice plates anchored to ribs welded to the reinforcing members.

Referring to FIG. 19, another splice method is achieved by attaching double splice plates 70 onto both sides of vertically aligned ribs 72 welded onto the angle reinforcement members 45. Tensile shear connectors 60 are inserted within the aligned cross holes 73 formed within the splice plates 70 and ribs 72. The ribs 72 may also be doubled by welding one rib on each wing portion 61 of the angle reinforcement member 45. This method takes advantage of the double shear action of the bolts installed through holes within each rib and double splice plates on each wing portion 61.

The location of a splice may occur at any location along the height of the monopole. At locations of monopole joints where a slip joint is used to join the monopole sections together, a slight step occurs in the monopole. This step may be accommodated by fabricating the reinforcing member steel so that the reinforcing member splice is located at this same location as the slip joint, and shims are used if required, under the reinforcing member splice. The reinforcing member may also pass over the monopole slip joint, and shims may be placed, if necessary, between the reinforcing member and monopole.

A reinforcing member may also be connected to the tower or monopole at mid-section locations along the length of the reinforcing members. A mid-section connector type is determined by how the shear forces are preferred to be transferred into the reinforcing member, that is, concentrated at the ends of the reinforcing member only or distributed along the length of the reinforcing member incrementally through shear flow. When the shear forces are transferred in a concentrated area at the ends of the reinforcing member 45 using tensile shear connectors 60 and/or shear pins 62, only intermediate bolts are required to resist out of plane buckling. This is accomplished using only tensile connectors 58 which are typically spaced at 48 inches apart on center on each wing portion 61 of the member 45. Preferably, the connectors 58 are staggered so that there is 24 inches vertical spacing between the blind bolt connectors.

When the shear forces are distributed along the length of a reinforcing member 45 incrementally through shear flow, each mid-section connector must be capable of carrying shear. This is accomplished using tensile shear connectors 60 or shear pins 62 located along the length of the reinforcing member. The same staggered connector pattern as used for the tensile connectors 58 is used for the tensile shear connectors 60.

Figure 2:
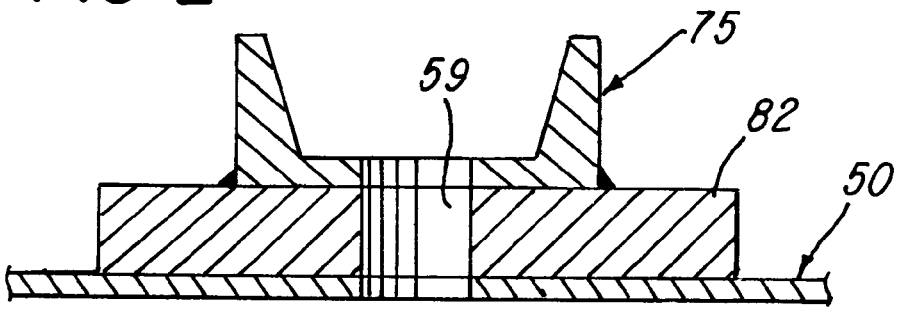
FIG. 2 is a fragmentary section of a monopole wall with a channel-type reinforcing member mounted on the wall in accordance with a second embodiment of the invention.
Figure 3:
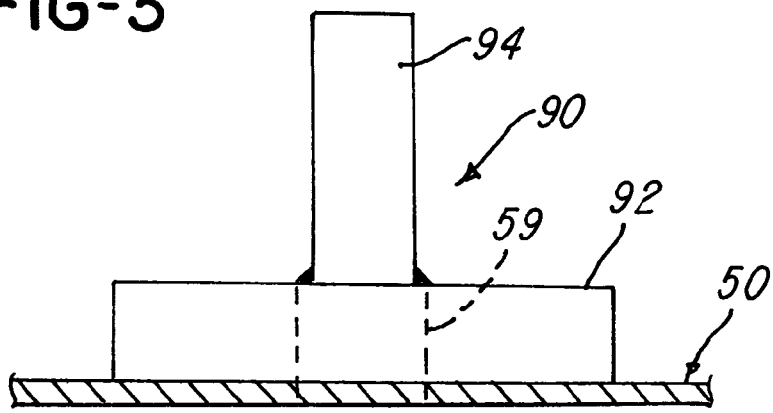
FIG. 3 is a fragmentary section of a monopole wall with a rib-type reinforcing member mounted on the wall in accordance with a third embodiment of the invention.
Figure 20:
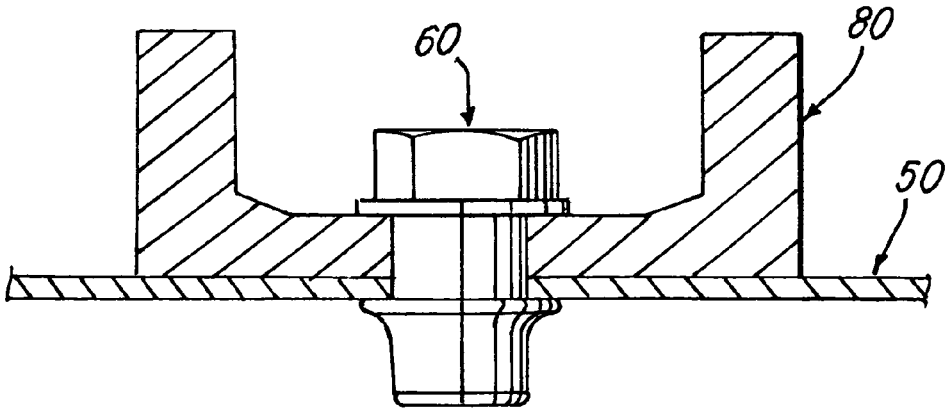
FIGS. 20 and 21 are sections similar to FIG. 2 and showing attachment of channel-type reinforcing members to a monopole wall.

Referring to FIGS. 2 & 20, channel-type reinforcing members 75 (FIG. 2) or 80 (FIG. 20) provide for a significant increase of the moment of inertia of the reinforcing member which improves its resistance to localized buckling under compression. The channel-type cross-section also hides the appearance of the exposed anchor heads of the connectors 58 and 60, which has a benefit for zoning approval. The channel-type section may be used for monopoles fabricated of multiple flat sides. The channel member 75 (FIG. 2) is welded to a flat base plate 82. The channel member 80 (FIG. 20) is formed as a one-piece member. When the same strength grade of steel is used to form the channel member 75 with the welded flat plate 82, the combined two members perform as one channel member such as the channel member 80. When the components of the channel member 75 have different strengths or when channel 75 is used for local buckling purposes only, it may not be necessary to weld the flat base plate 82 and channel 75 together.

Figure 21:
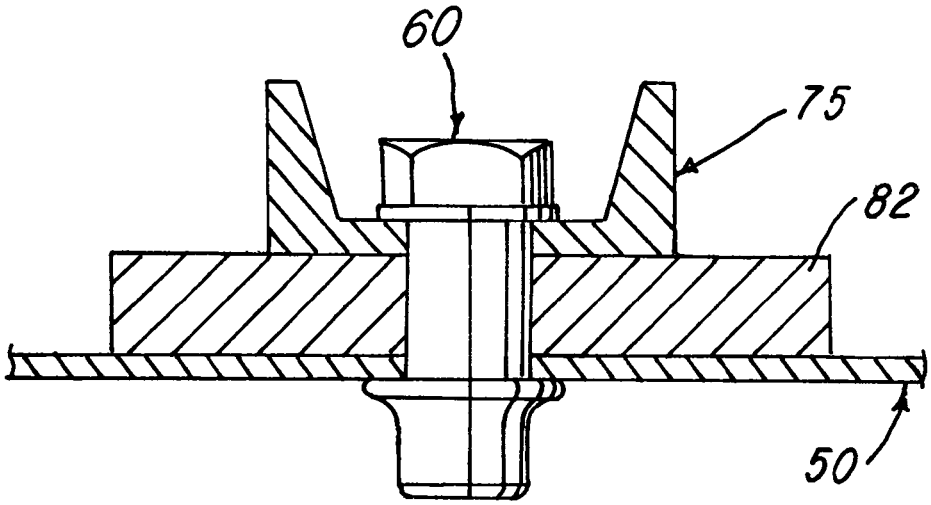

The channel section or member 75 or 80 may be fabricated to widths much narrower than the angle member 45, allowing more flexibility in the positioning of the reinforcement members when interferences (e.g., step bolts, port holes, safety cables, etc.) exist on the monopole. As an example, a channel member width may typically vary from 4 inches to 8 inches, and the member is mounted on one flat wall section of the monopole. The channel member may be fabricated using a channel and plate welded together (FIG. 2) or be formed as a single section (FIG. 20) or the channel 75 and plate 82 may be bolted together, as shown in FIG. 21, with connectors 60. Each channel member is attached to the monopole in a manner that the flanges of the channel are facing outwardly and the web of the channel is adjacent the monopole 50, as shown in FIGS. 2, 20, 21 and 22.

Figure 22:
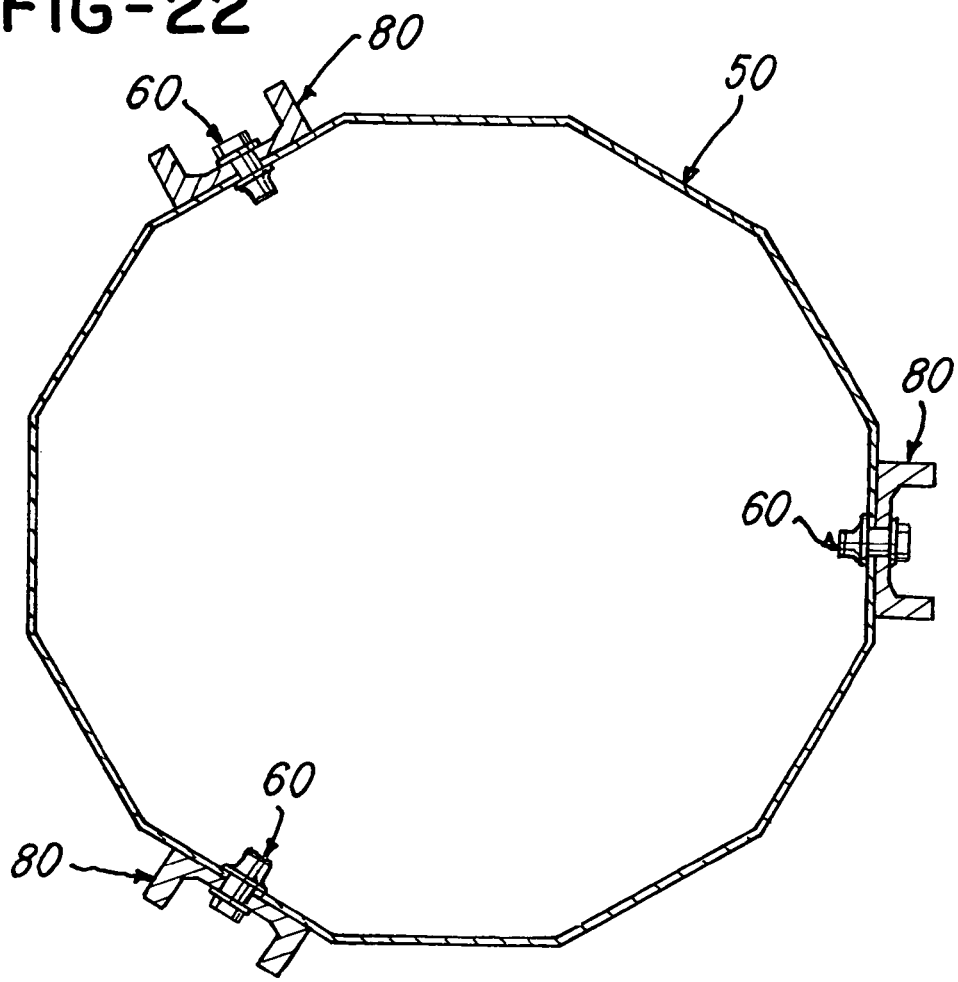
FIG. 22 is a horizontal section similar to FIG. 8 and showing the attachment of the channel-type reinforcing members of FIG. 20 to a monopole wall.
Figure 23:
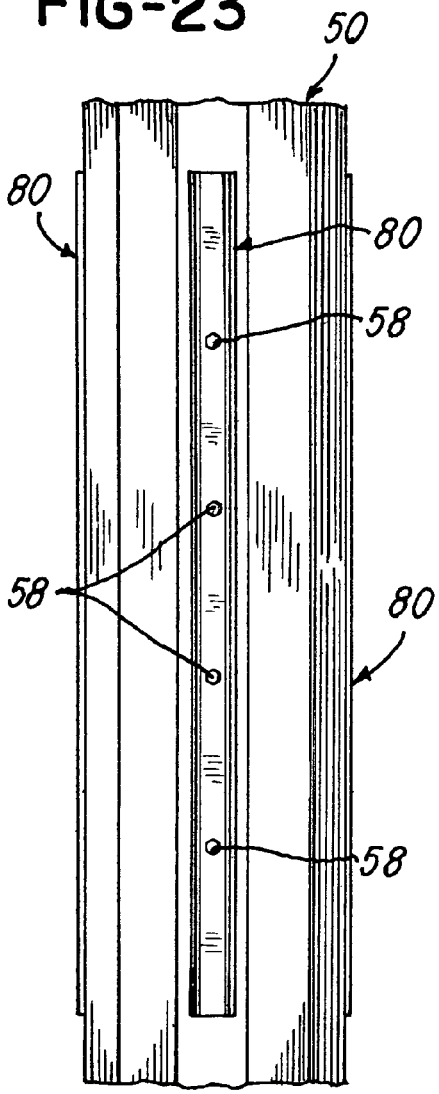
FIG. 23 is a fragmentary elevational view of a monopole with attached channel-type reinforcing members as shown in FIG. 20.

The channel section reinforcing member is typically 20 ft in length between splices or ends. This length is determined by weight and handling considerations and is installed as shown in FIG. 21 or 22. The channel section reinforcing member is connected to the monopole using tensile connectors (FIG. 4), tensile shear connectors (FIG. 5), or shear plate and pin assemblies 65 (FIG. 6). The connectors are placed at the ends of the reinforcing members so that the ends of reinforcing members are capable of transferring excess axial loads from the existing monopole to each reinforcing member. This is accomplished through shear transfer between the existing monopole and the reinforcing member.

Figure 24:
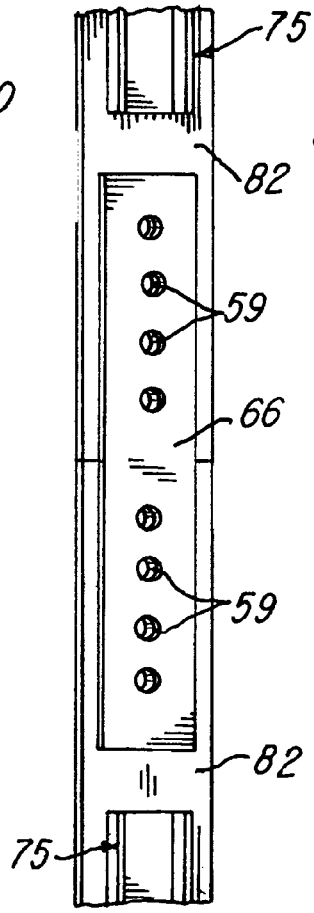
FIG. 24 is a fragmentary elevational view of a splice connection of two channel-type reinforcing members shown in FIG. 21.
Figure 25:
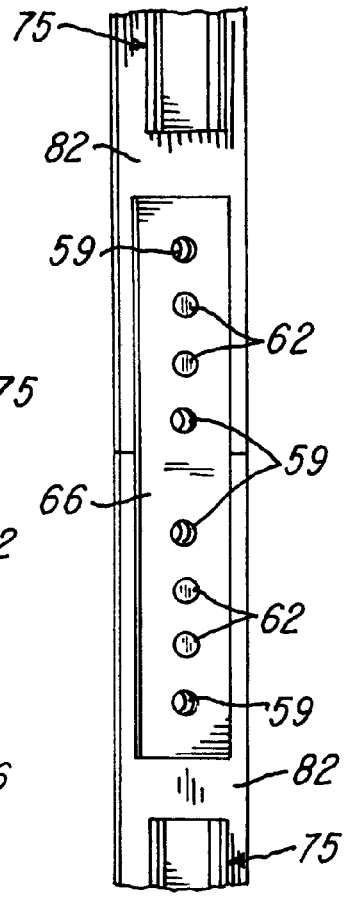
FIGS. 25 and 26 are fragmentary elevational views similar to FIG. 24 and showing installed splice connectors for the reinforcing members shown in FIG. 21
Figure 26:
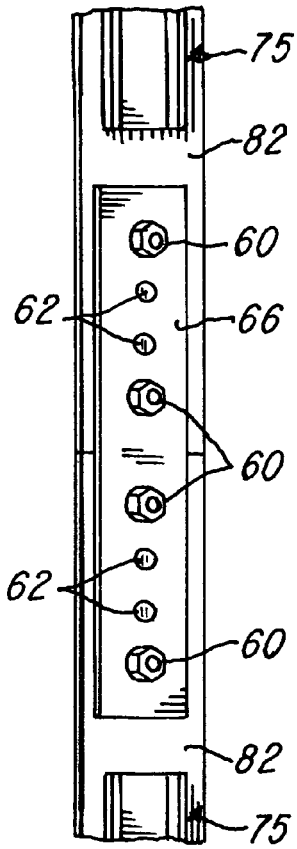

Shear transfer is achieved using tensile shear bolts 60 or a shear plate and pin assemblies 65 (FIG. 14). The same connectors used for fastening each side or wing portion of the folded or angle section or member 45 are used for fastening a channel section or member. The connectors or shear assemblies extend through the web between the flanges of a channel member, or the channel member may be located on a plate 82 which projects at opposite ends to provide a flat section for making a splice connection. Splices between two channel reinforcing members 75 or 80 are accomplished using splice plates 66 which overlap the web portions of adjacent end portions of vertically aligned channels 80 or overlap extensions of the base plates 82 of the channels 75 (FIGS. 24 & 25). The splice plates are secured by tensile shear connectors 60 in the holes 59 (FIG. 24), or by a combination of shear pins 62 with tensile shear connectors 60 (FIG. 25) in the holes 59 or the combination of shear pins 62 with only tensile connectors 58 (FIG. 26). The total number of shear pins 62 in a splice plate 65 may be reduced when tensile shear connectors 60 are used to fasten a splice plate 66.

Figure 27:
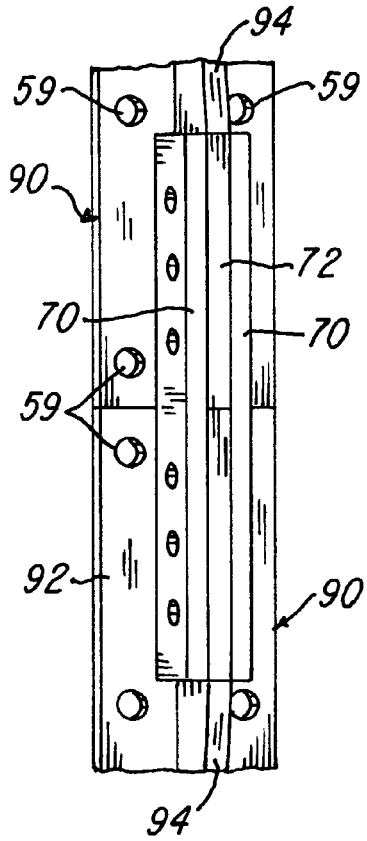
FIG. 27 is a fragmentary elevational view of a splice connector similar to FIG. 19 for joining two vertically aligned reinforcing members with attached ribs.

The splice methods described above in connection with FIG. 19 may also be used with channel sections by attaching double splice plates 70 onto opposite sides of ribs 72 welded to the web portions of adjacent channel members 80 or to the channel member reinforcement base plates 82 (FIG. 27). These methods take advantage of the double shear action of tensile shear bolts installed through holes in the ribs and double plates. The channel members 75 (FIG. 26) are recessed back from the ends of the base plates 82 which are welded to the ribs 72. The location of a splice may occur at any location along the height of a monopole. At locations of monopole joints where a slip joint is used to join monopole sections together, a step occurs in the monopole. This step is accommodated by using shims, if necessary, under the reinforcing member splice plate or between the reinforcing member and the monopole.

Connectors 58 or 60 are located along the length of the reinforcing members and are determined by how the shear forces are preferred to be transferred into the reinforcing member, that is, concentrated only at the ends of the reinforcing member or distributed along the length of the reinforcing member. When the shear forces are transferred in a concentrated area at the ends of the reinforcing member using tensile shear connectors 60 and/or shear pins 62, only intermediate connectors 58 are used to resist out of plane buckling. The tensile connectors 58 are typically spaced at 24 inches apart on centers. When the shear forces are distributed along the length of the reinforcing member incrementally through shear flow, each mid-section connector must be capable of carrying shear. This is accomplished using tensile shear connectors 60 and/or shear plate and pin assemblies 65 located along the length of the reinforcing member. The geometry or profile of the reinforcing member is selected to provide a 24 inch spacing of the connectors.

Figure 28:
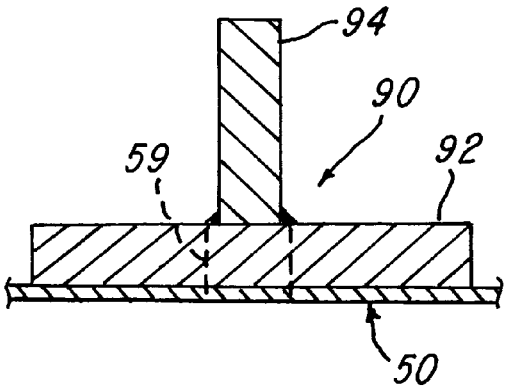
FIG. 28 is a section through a rib-type reinforcing member having the rib interrupted for center connectors to a monopole wall.
Figure 29:
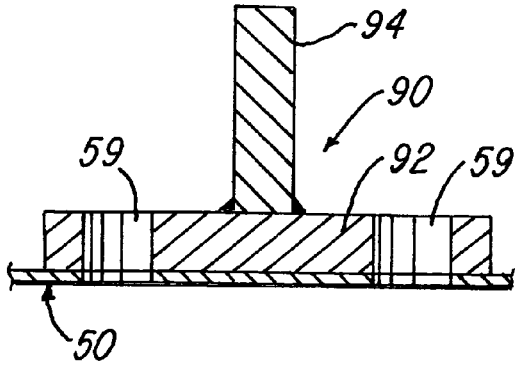
FIG. 29 is a section similar to FIG. 28 and showing a continuous rib-type reinforcing member mounted on a monopole wall.
Figure 30:
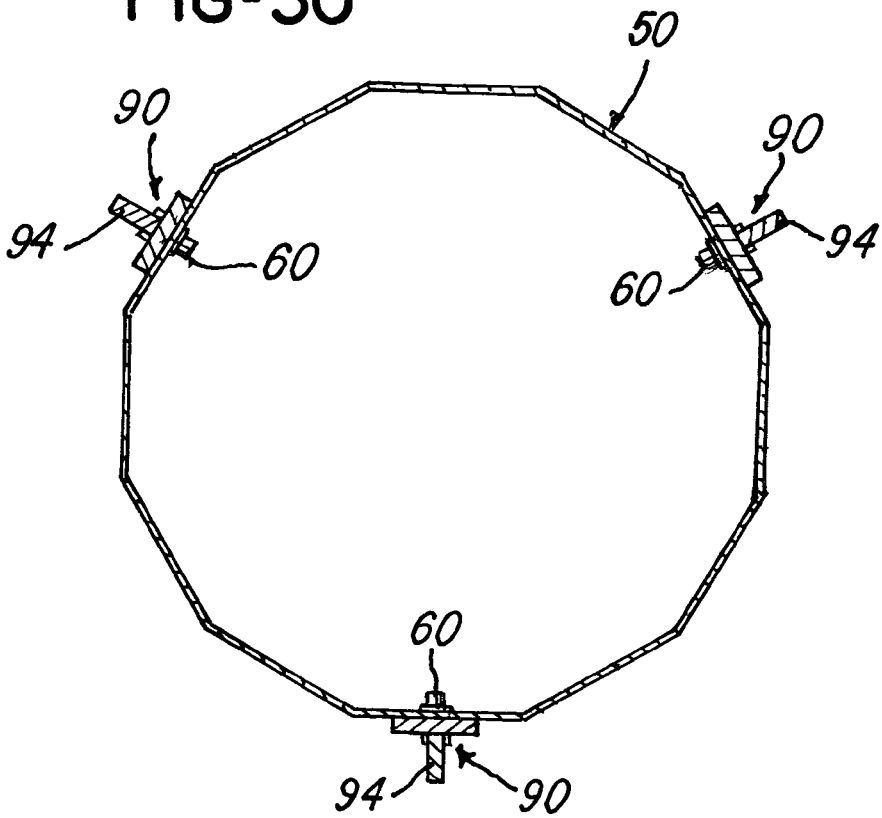
FIGS. 30 and 31 are greatly reduced horizontal sections similar to FIGS. 8 and 9 and showing the attachment of the rib-type reinforcing members of FIGS. 28 and 29 to a monopole wall, respectively.
Figure 31:
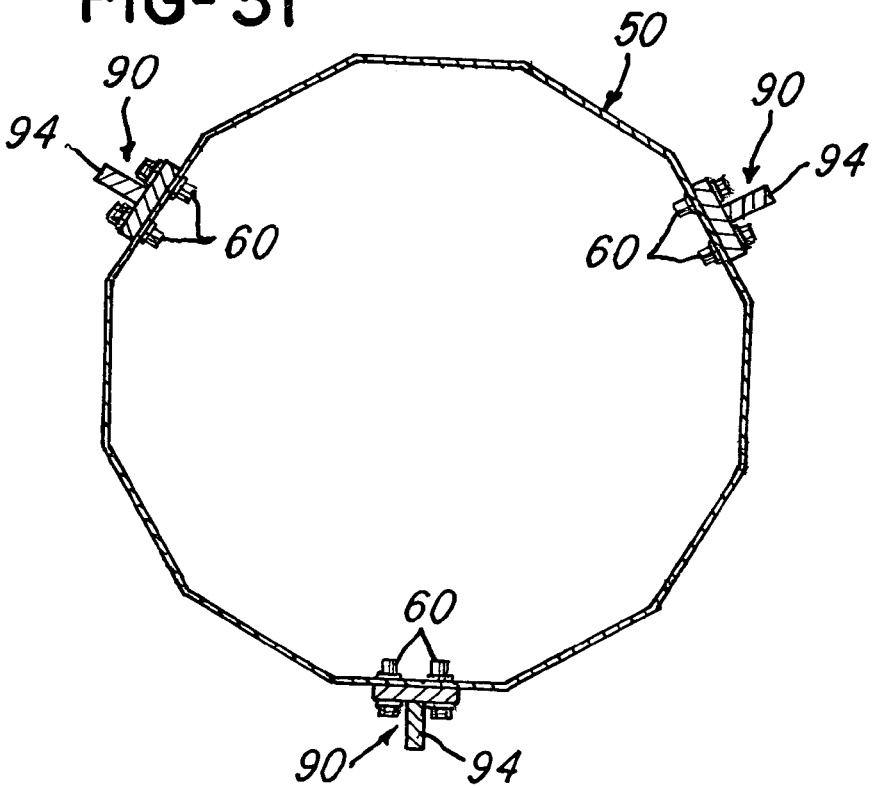
Figure 32:
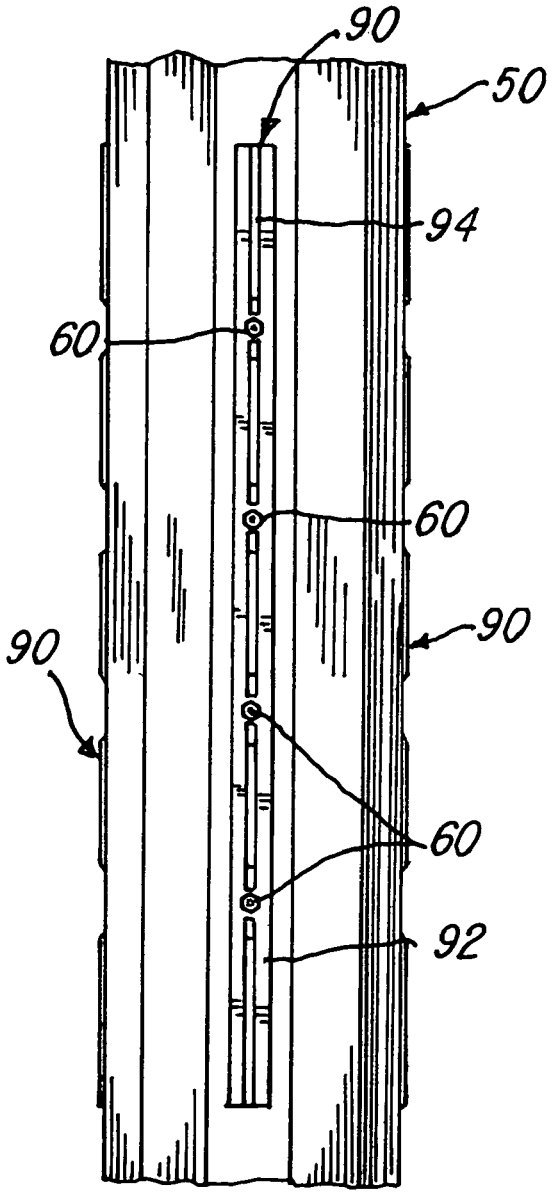
FIG. 32 is a fragmentary elevational view of the monopole and attached reinforcing members shown in FIGS. 28 and 30.
Figure 33:
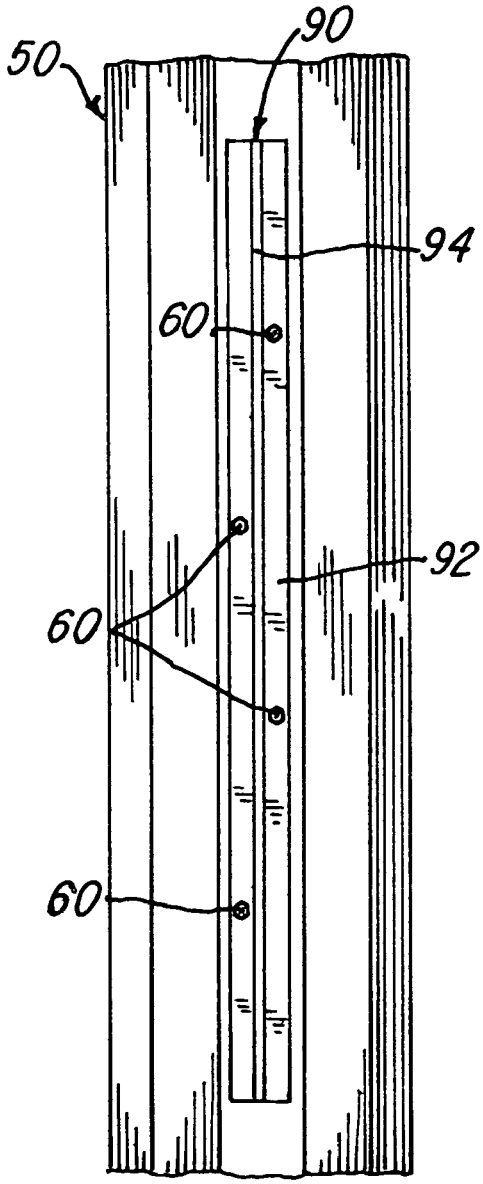
FIG. 33 is a fragmentary elevational view of the monopole with a rib-type reinforcing member shown in FIGS. 29 and 31.
Figure 34:
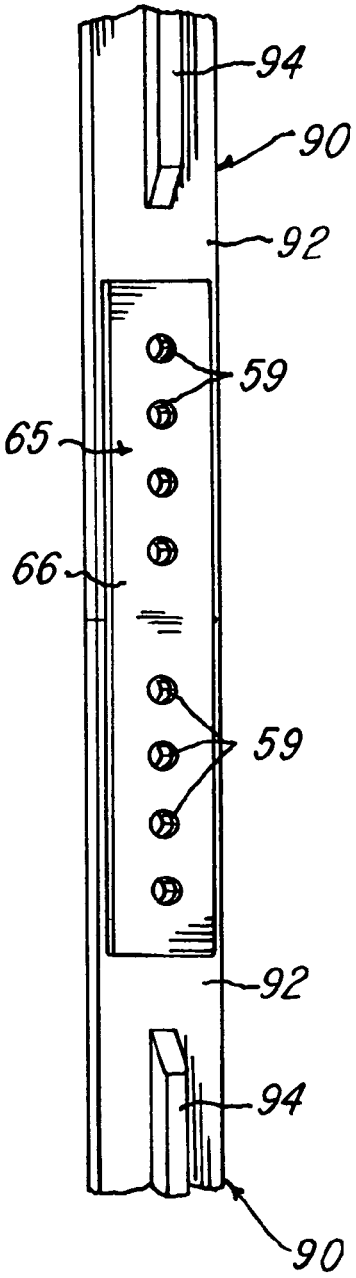
FIGS. 34-36 are fragmentary perspective views showing splice connections of the rib-type reinforcing members shown in FIGS. 28 and 29.

A ribbed-type reinforcing member 90 (FIGS. 3 & 28-39) also provides for a significant increase of the moment of inertia of the reinforcing member which improves its resistance to localized buckling under compression. This section or member is used for monopoles fabricated of multiple flat sides. Connectors 58 or 60 are placed in the center of the base plate 92 when the ribs 94 are interrupted (FIGS. 28, 30 & 32) or in the base plate 92 on opposite sides of a continuous rib (FIGS. 29, 31 & 33).

A ribbed-type reinforcing member or rib section 90 (FIGS. 3 and 28-39) may be fabricated in widths much narrower than the angle member or section 45, allowing for more flexibility in positioning of the reinforcement members when interferences (e.g., step bolts, port holes, safety cables, etc.) exist on the monopole. As an example, a rib section or member width typically varies from 4 inches to 8 inches and is placed on a flat wall of the monopole 50. Rib sections may be spliced together using double shear side plates as described above in connection with FIG. 27. The ribbed section reinforcing member 90 is typically 20 ft in length between splices or ends. This length is determined by weight and handling considerations.

The rib section reinforcing member 90 is connected to the existing monopole 50 using tensile connectors 58, tensile shear connectors 60, or shear pins 62 with connecter plates 66. When the connectors are placed at the ends of the reinforcing members, the ends of reinforcing members must be capable of transferring excess axial loads from the existing monopole to the reinforcing member. This is accomplished through shear transfer between the existing monopole and the reinforcing member. Shear transfer is achieved using tensile shear connectors 60 or a shear plate and pin assembly 65 (FIG. 14) having shear pins 62. The same connector details used for fastening each wing portion 61 of the folded or angle section 45 are used for fastening a rib section 90. The rib 94 welded to the plate 92 is recessed back from the end of the plate to provide a flat section of the plate for making a splice connection.

Figure 35:
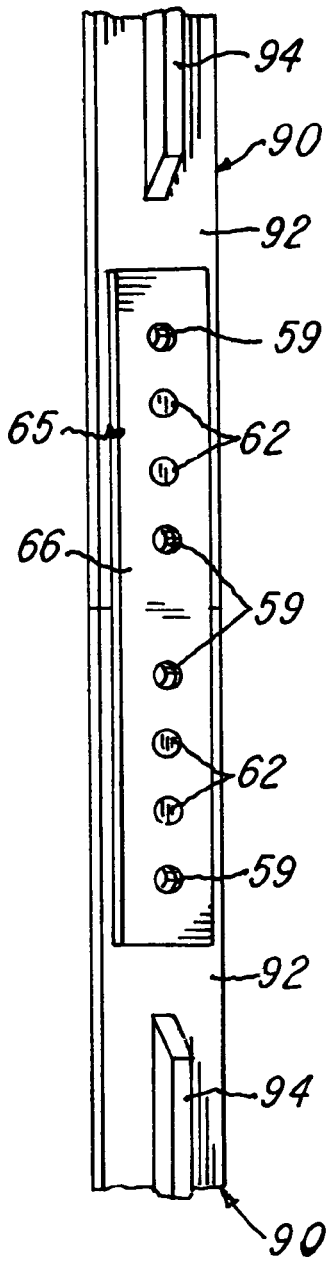
Figure 36:
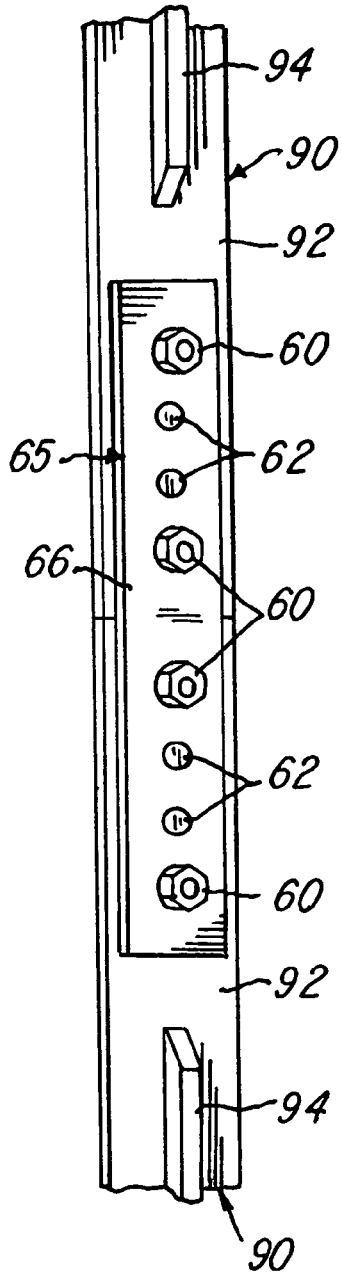

The splices may be located between two ribbed-type reinforcing members 90 and may be accomplished using all tensile shear connectors 60 in the holes 59 in the splice plate 65 (FIG. 34) or shear plate and pin assemblies 65 and tensile connectors 58 in holes 59 (FIGS. 35 & 36). The total number of shear pins 62 in a shear plate and pin assembly 65 may be reduced when tensile shear connectors 60 are used to splice with the shear plate and pin assembly 65.

Figure 37:
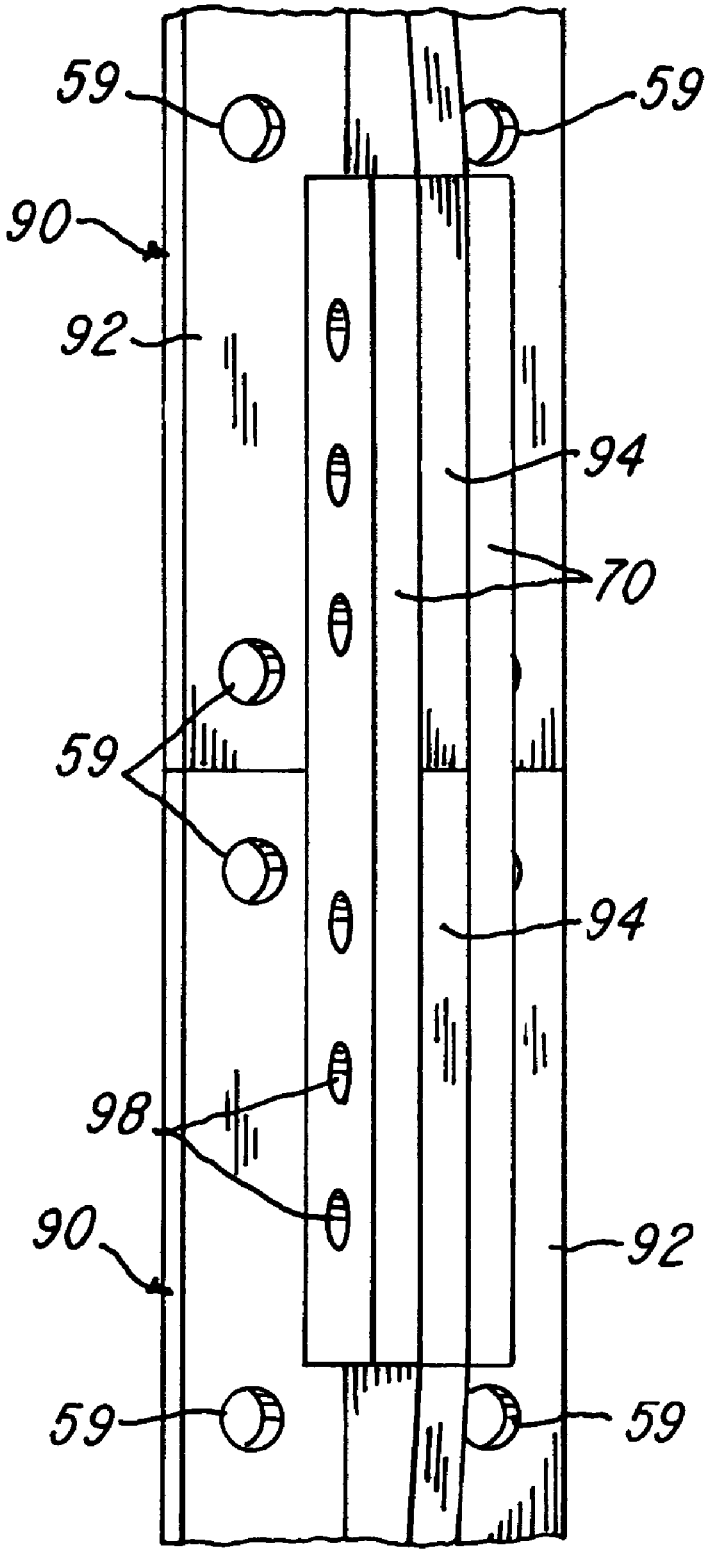
FIG. 37 is a larger fragmentary perspective view of the splice connector shown in FIG. 27.
Figure 38:
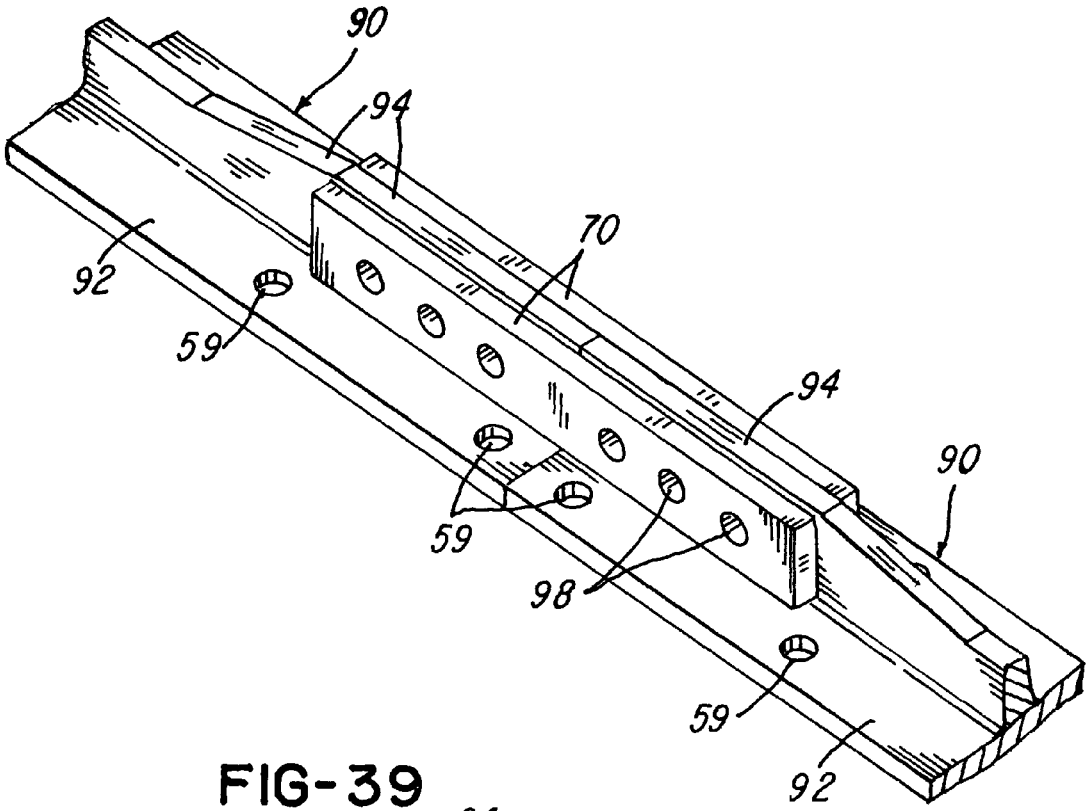
FIG. 38 is a fragmentary perspective view of the splice connector shown in FIG. 37.
Figure 39:
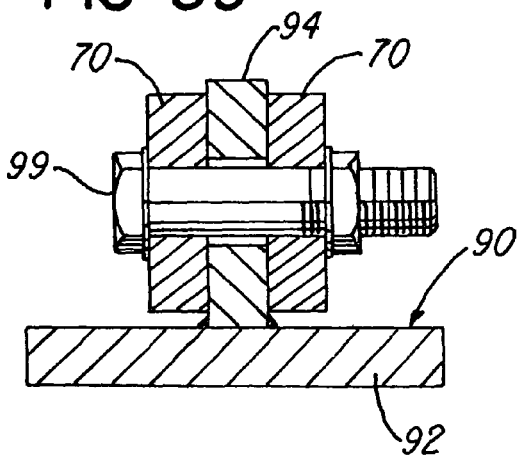
FIG. 39 is a cross-section of the splice connector shown in FIG. 38 after receiving connector bolts.

Referring to FIGS. 37 & 38, a splice method for rib-type reinforcing members 90 may be achieved by attaching double splice plates 70 on opposite sides of ribs 94 that are welded on the plates 92 of the reinforcement members 90. This method takes advantage of the double shear action of the bolts installed through holes within the rib and double plates. The connection of the rib-type members 90 are determined by how the shear forces are preferred to be transferred into the reinforcing members, that is, concentrated at the ends of each reinforcing member only or distributed along the length of each reinforcing member 80 or 90 incrementally through shear flow.

When the shear forces are transferred in a concentrated area at the ends of the reinforcing member, for example, by using tensile shear connectors 60 or shear pins 62, intermediate bolts or tensile connectors 58 are only required to resist out of plane buckling. Tensile connectors 58 are typically spaced at 48 inches apart on centers between intermittent ribs 94 (FIG. 32) or can be staggered on opposite sides of a continuous rib 94 in an alternating manner and spaced 48 inches apart, as shown in FIG. 33.

When the shear forces are distributed along the length of the reinforcing member incrementally through shear flow, each mid-section connector must be capable of carrying shear. This is accomplished using tensile shear connectors 60 or shear plate and pin assemblies 65 located along the length of the reinforcing member. The plate 92 of the section or member 90 is selected to allow for a 48 inch spacing of the connectors 60. The same linear or staggered connector pattern used for the tensile connectors 58 can also be used for the tensile shear connectors 60.

Additional details associated with a splice connector of FIGS. 27 & 37 include the relation of the monopole 50 to the reinforcing member 90 so that raising up of the reinforcing member 90 does occur under axial loads in the member 90. When the ribbed section in FIG. 38 or member 90 is under compression or tension, the connectors 58 located in holes 59 assist in keeping the plate 92 of the ribbed member 90 against the monopole 50. This behavior is a result of the double splice plates. 70 being eccentric to the neutral axis of the ribbed member 90.

While the forms of monopole reinforcing members and their methods of attachment herein described constitutes preferred embodiments of the invention, it is to be understood that the invention is not limited to the precise methods and reinforcing members described, and that changes may be made therein without departing from the scope and spirit of the invention as defined in the appended claims.

What is claimed is:

1. A system for reinforcing an existing vertical monopole tower having an annular tower wall in horizontal cross-section and adapted to increase the capacity of the tower for supporting communication antennas, said annular tower having generally vertically extending flat outer surfaces around the periphery of said tower, said system comprising a plurality of elongated rigid reinforcing channels extending substantially vertically on peripherally spaced said outer surfaces of said tower wall, each of said channels having parallel spaced flange portions integrally connected by a web portion and defining a longitudinally extending and outwardly facing opening, each of said flange portions of each said channel having a uniform wall thickness substantially greater than a uniform wall thickness of said web portion, said web portion and said flange portions of each said channel having a flat base surface mounted directly on and contacting one of said flat outer surfaces of said tower wall, said web portion of each said channel having longitudinally spaced circular holes, said tower wall having vertically spaced circular holes aligned with and having the same diameter as said holes within said web portion of said each said channel, and blind tensile shear connectors extending through and tightly filling the aligned said holes without clearance and positively securing said reinforcing channels to said flat outer surfaces of said tower wall.

2. A system as defined in claim 1 wherein each of said tensile shear connectors includes a tubular shear sleeve extending through the corresponding aligned said holes within said web portion of said channel and said tower wall.

* * * * *